US007913328B2

(12) United States Patent
Halloran

(10) Patent No.: US 7,913,328 B2
(45) Date of Patent: Mar. 29, 2011

(54) TOILET TANK CONNECTOR ASSEMBLY

(75) Inventor: Daniel N. Halloran, Saukville, WI (US)

(73) Assignee: Kohler Co., Kohler, WI (US)

( * ) Notice: Subject to any disclaimer, the term of this patent is extended or adjusted under 35 U.S.C. 154(b) by 1008 days.

(21) Appl. No.: 11/524,163

(22) Filed: Sep. 20, 2006

(65) Prior Publication Data

US 2008/0066223 A1 Mar. 20, 2008

(51) Int. Cl.
*E03D 1/00* (2006.01)

(52) U.S. Cl. ..... 4/353; 4/417; 4/252.5

(58) Field of Classification Search ..... 4/417–419, 4/353, 252.4–252.6

See application file for complete search history.

(56) References Cited

U.S. PATENT DOCUMENTS

| | | | | |
|---|---|---|---|---|
| 773,734 | A * | 11/1904 | Griffiths | 4/252.5 |
| 870,018 | A | 11/1907 | Cosgrove | |
| 879,176 | A * | 2/1908 | Jackson | 4/252.5 |
| 919,283 | A * | 4/1909 | Cosgrove | 4/252.4 |
| 2,590,471 | A * | 3/1952 | Smith | 4/419 |
| 2,700,774 | A | 2/1955 | Smith | |
| 2,743,460 | A * | 5/1956 | Youngstrom et al. | 4/417 |
| 3,142,845 | A | 8/1964 | Fulton | |
| 3,448,466 | A * | 6/1969 | Haldopoulos | 4/417 |
| 3,860,972 | A | 1/1975 | Costello | |
| 3,871,034 | A * | 3/1975 | Weigel | 4/252.6 |
| 4,090,267 | A * | 5/1978 | Cuschera | 4/252.5 |
| 4,757,560 | A * | 7/1988 | Grimstad | 4/417 |
| 5,185,890 | A * | 2/1993 | Dismore et al. | 4/252.5 |
| 5,295,273 | A * | 3/1994 | Unger et al. | 4/417 |
| 6,728,976 | B1 | 5/2004 | Halloran | |

FOREIGN PATENT DOCUMENTS

| | | |
|---|---|---|
| EP | 0187657 A2 | 7/1986 |
| EP | 1108821 A1 | 6/2001 |
| FR | 2700194 | 7/1994 |
| JP | 11013886 | 1/1999 |
| JP | 2000120874 | 4/2000 |

OTHER PUBLICATIONS

PCT International Search Report, Form PCT/ISA/210, 7 pages.

* cited by examiner

*Primary Examiner* — Khoa D Huynh
(74) *Attorney, Agent, or Firm* — Quarles & Brady LLP

(57) ABSTRACT

"Two piece" toilets have a toilet tank outlet valve that links the tank water with a bowl. A nut and gasket structure are provided to provide an essentially ball and socket type joint between the tank and bowl to permit correction for out of plumb conditions without significantly compromising seal integrity. The gasket has an outward lower curvature and is supported from the inside by the nut. Preferably the lower end of the nut is cut away or curved such that in some configurations the gasket can flex inwardly, while being otherwise supported by the nut.

11 Claims, 6 Drawing Sheets

FIG. 5
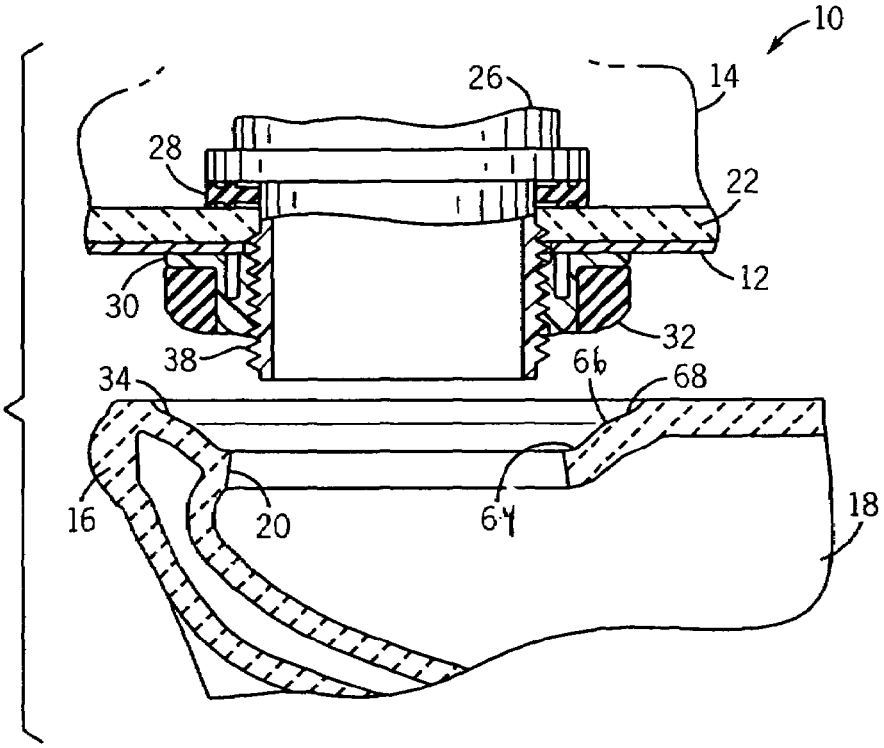
FIG. 6
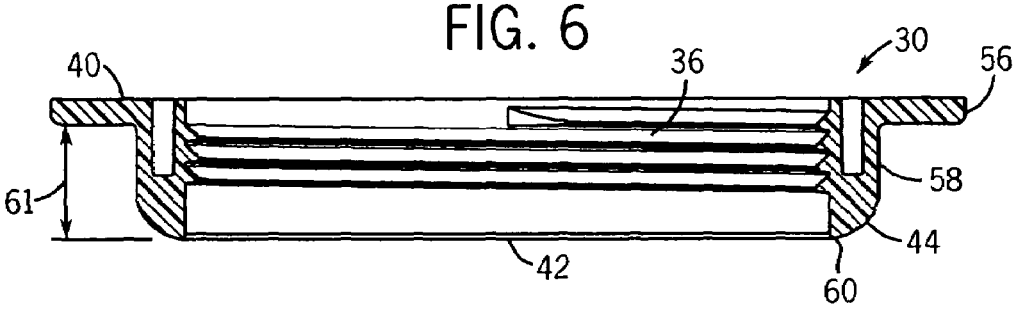
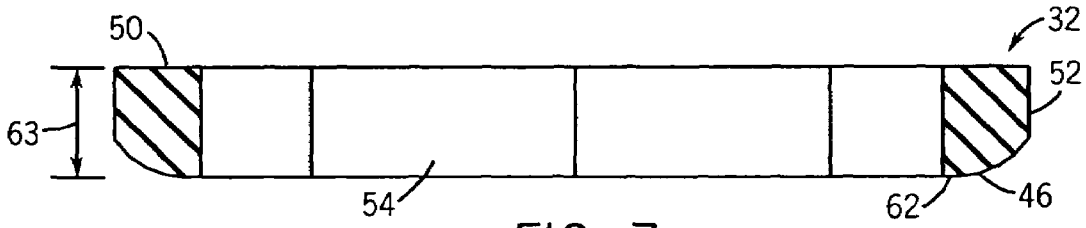
FIG. 7

TOILET TANK CONNECTOR ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to toilets of the "two piece" type (tank and bowl are separately formed pieces). More particularly it relates to connector assemblies capable of linking such a toilet tank to a toilet base in a way that corrects for out of plumb supporting floor conditions.

During construction of a home or other building it is common for a bathroom floor to be slightly sloped. If a toilet base is installed on a sloped floor, and the tank which is mounted thereon has no way to correct for this out of plumb condition, the top of the tank will also have a slight tip to it. This condition may be aesthetically unacceptable, particularly where there is a plumb visual reference such as a nearby window molding or wall paper striping. Further, it is common for items to be placed on a toilet tank cover. An out of plumb condition uncorrected for could lead to such items not being properly supported on the tank cover.

Attempts to correct for an out of plumb condition by changing the slope of the floor can be very expensive and cause construction delays. Attempts to address the problem by adjusting the junction between the base and the floor could leave an undesirable gap between portions of the lower base and the floor, and in any event may be difficult to achieve depending on the sewer system used.

Another way of trying to overcome such an out of plumb condition is to provide a shim between the toilet bowl and toilet tank. However, shims are not normally included with a new toilet, and correctly shimming can be time consuming and require some carpentry or plumbing skill. Further, a typical installer is not likely to be pleased if they have to use shims. Even more problematic, a shimmed connection might lead to leakage at the joint between the outlet valve extension and the bowl inlet.

Unrelated to this concern it should be noted that most two-piece toilets have been connected to bowl rear extensions using bolts extending from inside the tank, through the tank bottom wall, and then into and through bowl rear extensions. These assemblies require special care to avoid leakage through the tank bottom wall along the bolt, and in any event complicate adjustments in the relative positioning of the tank with respect to the bowl.

A recent improved connector bracket is described in U.S. Pat. No. 6,728,976, the disclosure of which is incorporated by reference as if fully set forth herein. This bracket is positioned under the tank. It suspends attachment bolts that don't need to extend through the tank. This has the advantage of not requiring holes to be formed in the tank bottom wall for the bolts. However, it does not provide for correction for out of plumb conditions.

Hence, a need still exists for improved two-piece toilet assemblies where out of plumb support conditions can be readily corrected for.

SUMMARY OF THE INVENTION

In one aspect the present invention provides a toilet. There is a tank with an outlet valve, the outlet valve having an extension projecting through a lower wall of the tank. There is also a bowl having an upper rearward portion with an inlet suitable for receiving water from the tank through the valve extension.

The valve extension has mounted thereon a nut and a gasket. The gasket is positioned radially outward of the nut, the gasket having an outwardly curved sealing surface disposed at a lower radially outward edge of the gasket. The bowl inlet has an inwardly directed entry surface upon which the gasket outwardly curved sealing surface abuts and seals.

Because of these surfaces, the tank can be adjustably tilted relative to the bowl rearward portion forward-to-back and/or side-to-side, to correct for out of plumb conditions, without significantly compromising seal integrity.

In one preferred form the nut has an outwardly curved surface or cut away disposed at a radially outward edge of the nut so as to permit a lower edge of the gasket to flex inwardly under certain tilting conditions. The nut can also facilitate clamping of the outlet valve to the tank by extending both above and inward of the gasket. The nut also provides sealing support for the gasket.

In other preferred forms the gasket has a flat upper annular ring surface, and an outer circumferential vertically extending surface depending from said flat annular ring surface. Further, the radially outwardly curved edge of the gasket depends from said vertically extending surface. The nut also has a polygonal array of radially outward sides to facilitate tightening with a tool, and the gasket has a polygonal inner configuration suitable to tightly abut against said array.

In other preferred forms of the invention the inlet of the bowl has an upper inwardly dished surface linked to a somewhat lower outwardly dished surface, and the gasket is formed from a compressible material such as a rubber or a synthetic plastic open-celled foam. Alternatively, the bowl could have a simple chamfer.

While the present invention can be implemented in the context of bolting systems which project through the bottom of the tank wall, it is preferred to provide a bracket positioned between said tank and nut, the bracket being mounted on the valve extension and supporting fasteners that extend from above the bracket (albeit below the tank), through a portion of the rearward portion of the bowl. This permits out of plumb adjustability, without requiring connector bolts extending through the tank lower wall.

In another form the invention provides a gasket/nut combination suitable to facilitate sealing a connection between a toilet tank having an outlet valve, the outlet valve being of the type having an extension projecting through a lower wall of the tank, and an upper rearward inlet of a toilet bowl portion suitable for receiving water from the tank through the portion. The nut is suitable to be mounted on such an outlet valve extension, the nut having a threaded interior, an upper radially extending flange, and a polygonal side wall radially outer array. The gasket is suitable to be mounted on such a nut so as to be under the flange and radially outward of the side wall array, such that the lowermost portion of the nut is at essentially the same height as the lowermost portion of the gasket.

In still another form the invention provides a method of adjusting a tank of a toilet to essentially compensate for out of plumb floor support conditions. One obtains a toilet of the above kind and positions it on a floor that is out of plumb. One then tilts the toilet tank relative to its bowl to establish a more plumb configuration for the tank (while the extension projects into the entry of the bowl). One then tightens the fastener to fix the parts in place.

The present invention thus permits the adjustment of a toilet tank on a toilet bowl to correct for out of plumb conditions. One can place a level on top of the tank before the fastener is tightened, and position the tank as needed to provide the correct tilting to reach level on the toilet tank top.

This correction can be made with minimal labor, and does not require substantial plumbing or carpentry skill to achieve. Further, this system is adaptable to a wide array of two-piece type toilets. These advantages are achieved while maintaining a seal between the toilet tank and toilet bowl, even if the toilet tank is substantially tilted relative to the toilet bowl.

The gasket and nut of the present invention are inexpensive to manufacture and reliable for long-term use. Thus, their use does not significantly increase the cost of the toilet.

These and still other advantages of the present invention will be apparent from the detailed description and drawings. What follows are merely preferred embodiments of the present invention. To assess the full scope of the invention the claims are looked to.

BRIEF DESCRIPTION OF THE DRAWINGS

FIG. 5 is a view similar to FIG. 4 but with the tank slightly raised relative to the base;

FIG. 6 is a cross-sectional view of a nut according to the present invention taken along line 6-6 in FIG. 3;

FIG. 7 is a cross sectional view of a gasket according to the present invention taken along line 7-7 in FIG. 3;

DETAILED DESCRIPTION OF THE PREFERRED EMBODIMENTS

Figure 1:
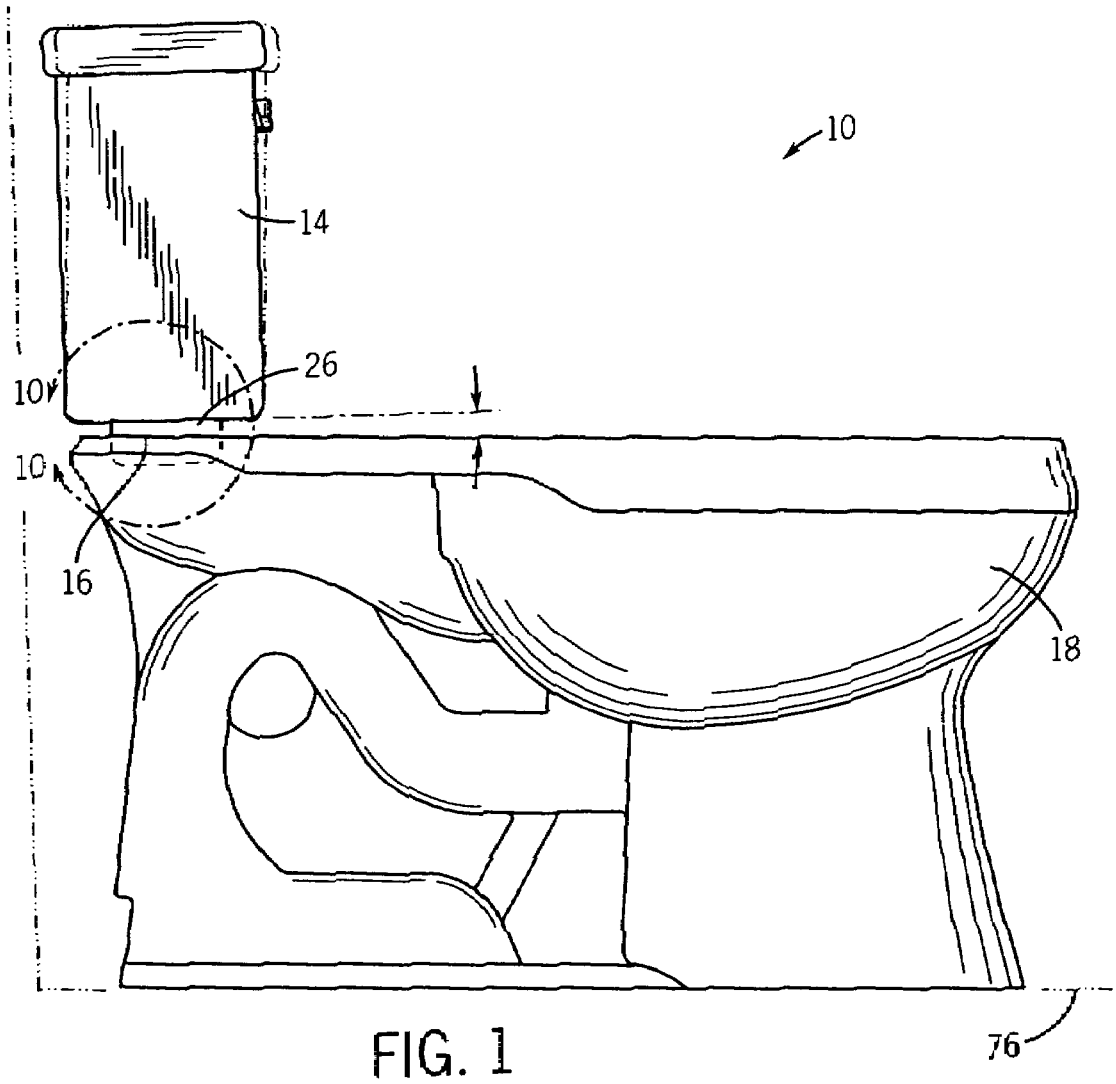
FIG. 1 is a left side elevational view of a toilet embodying the present invention.

There is shown in FIGS. 1-4 a "two-piece" toilet 10 having a bracket 12 for attaching a water storage tank 14 to a rearward bowl portion 16 of a toilet bowl or base 18. The bowl 18 (including its portion 16) can be made of conventional toilet materials such as vitreous porcelain or china casting. However, other materials can be used as well.

Rearward portion 16 is formed with an inlet aperture 20, which leads to the bowl 18. Tank 14 has a bottom wall 22 with a main flush outlet 24 through which extends an extension 26 of a conventional flush valve, and about which a washer 28 fits to seal the flush outlet 24 through the use of conventional flange 25.

Nut 30 can be threaded onto the extension 26 from the underside of bracket 12. Under that can be fit a sealing gasket 32, which gasket contacts a sealing surface 34 of bowl portion 16. Nut 30 includes a threaded inside diameter 36 complementary with a threaded outside diameter 38 of extension 26.

Nut 30 also has a tank directed side 40 and a bowl directed side 42. The bowl directed side 42 has a first outwardly curved/convex surface 44. Gasket 32 includes a gasket sealing surface in the form of a downwardly and radially inwardly curved/convex surface 46, for contact with an inwardly directed bowl sealing surface 34. Gasket sealing surface 46, bowl sealing surface 34 and nut 30 constitute essentially a ball and socket/universal joint arrangement (generally 48) which allows tank 14 to be adjusted side-to-side and front-to-back relative to bowl 18, while still maintaining a fluidic seal.

Referring next to FIG. 7, note that gasket 32 has a flat annular ring surface 50, an outer circumferential surface 52 approximately perpendicular with and extending from flat annular ring surface 50, and convex surface 46 extending from the outer circumferential surface 52. Gasket 32 preferably further includes an inner polygonal surface 54, and can be made of an open cell foam, for example.

Referring now to FIG. 6, note that nut 30 includes a flange 56 connected with an outer polygonal surface 58 complementary with inner polygonal surface 54 of gasket 32. Surface 44 transitions from outer polygonal surface 58 to a perimeter surface 60 opposite flange 56.

Gasket 32 also includes a flat surface 62 which extends from convex surface 46, and when gasket 32 rests on nut 30 such that flat annular ring 50 contacts flange 56, perimeter surface 60 extends approximately to, or as shown in FIG. 1 for example, beyond (although slightly) flat surface 62. In other words, height 61 of nut 30 is equal to or greater than gasket height 63 of gasket 32 (greater as shown).

One reason for this is to provide good lateral support for the seal. However, the cut away or curvature 44 (a downwardly and radially inwardly curved surface disposed at a radially outward edge of the nut) also allows the lowest outer surface of the gasket to flex inwardly if needed to maintain a seal.

Convex/outwardly curved surfaces 44 and 46 can be circular arcs, of the same, or different radii. Alternatively surfaces 44 and 46 can be elliptical, parabolic, hyperbolic, other complex shapes and/or combinations thereof.

Figure 11:
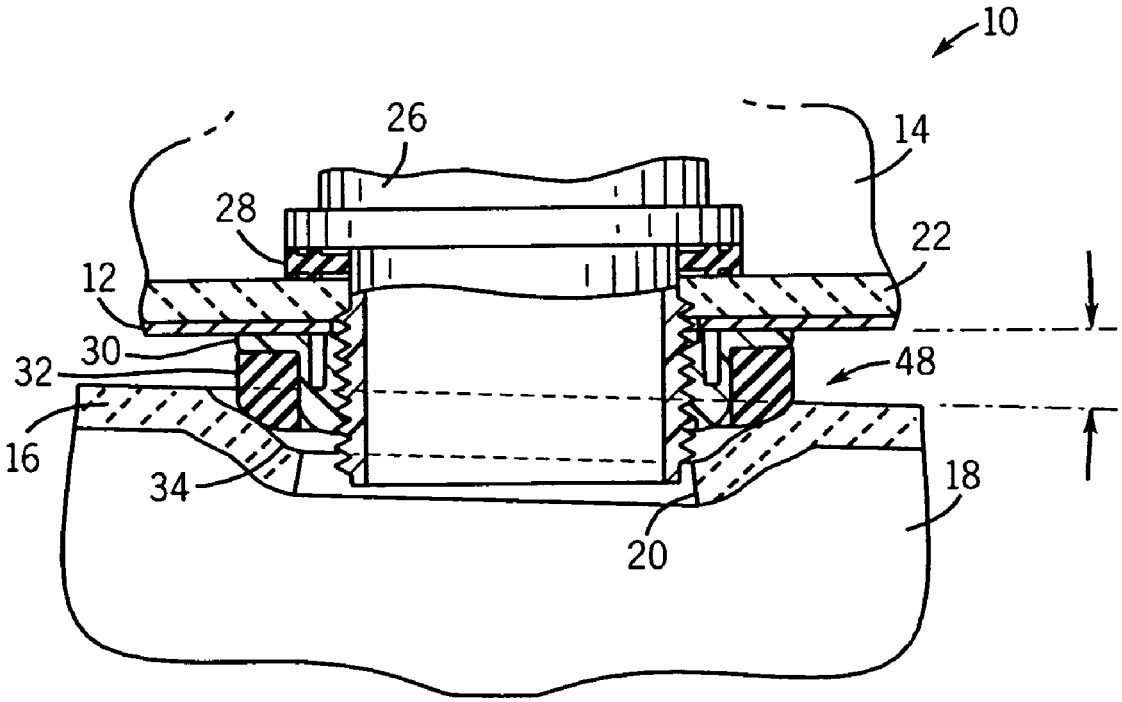
FIG. 11 is a view similar to FIG. 10, but a detail 11-11 of FIG. 9.

One possible bowl sealing surface 34 includes an inner concave (inwardly dished) contour 64 transitioning to a middle convex contour 66. Optionally there may also be an outer concave contour 68. Alternatively the sealing surface could be sloped or otherwise inwardly directed. As shown in FIG. 11 this will result in edge 44 being suitable to mate with inward dishing contour 68, thereby creating a ball and socket joint. Alternatively the sealing surface could be sloped or otherwise inwardly directed.

Figure 9:
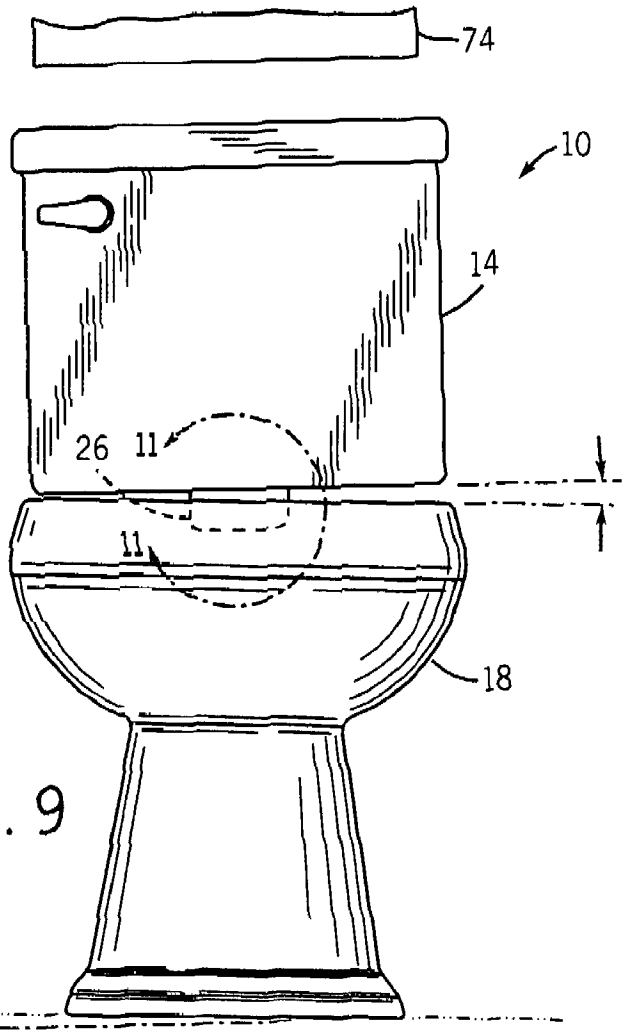
FIG. 9 is a view similar to FIG. 8, but showing the base out of plumb, side-to-side.
Figure 8:
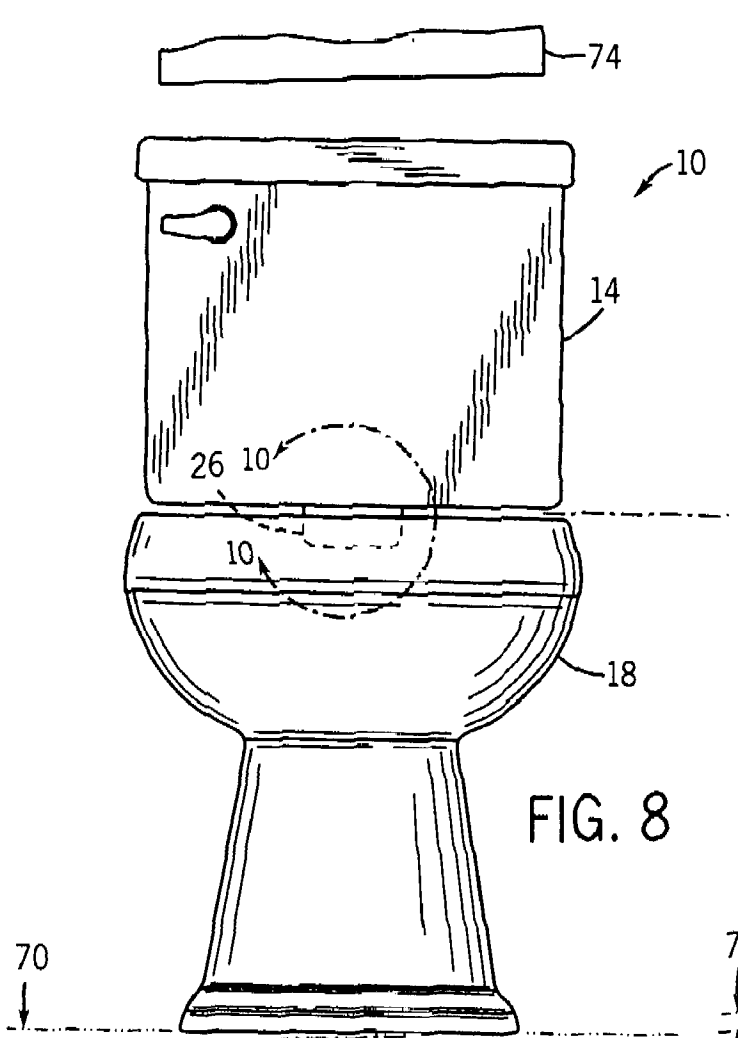
FIG. 8 is a frontal view of the toilet of FIG. 1, showing the base in a completely plumb condition side-to-side.
Figure 10:
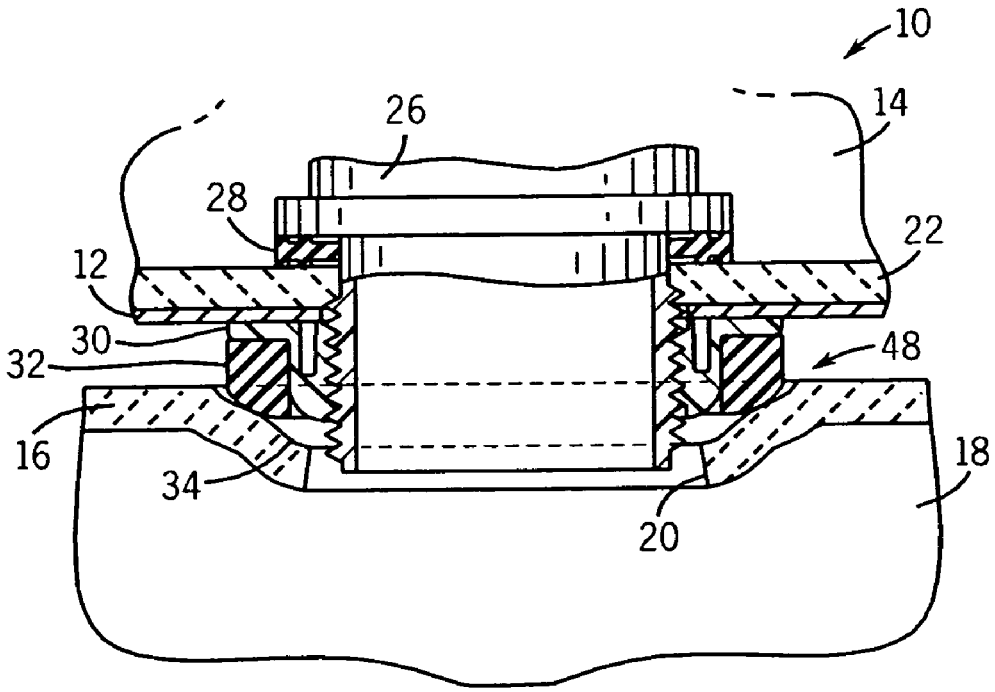
FIG. 10 is a fragmentary, partial cross sectional view of detail 10-10 of FIG. 8.

FIGS. 8 through 11 illustrate how if the toilet base 18 is placed on a side-to-side sloped floor the tank 14 can be tipped back to plumb without compromising seal integrity. Specifically, there is shown a sloped floor 70 (relative to plumb line 72). In FIGS. 8 and 10 the tank 14 is parallel with respect to bowl 18, and thus not level with respect to plumb line 72, or another extrinsic reference such as a window sill 74. However, as depicted in FIGS. 9 and 11, tank 14 can be adjusted while on bowl 18 so that it becomes plumb while the base remains out of plumb.

Figure 4:
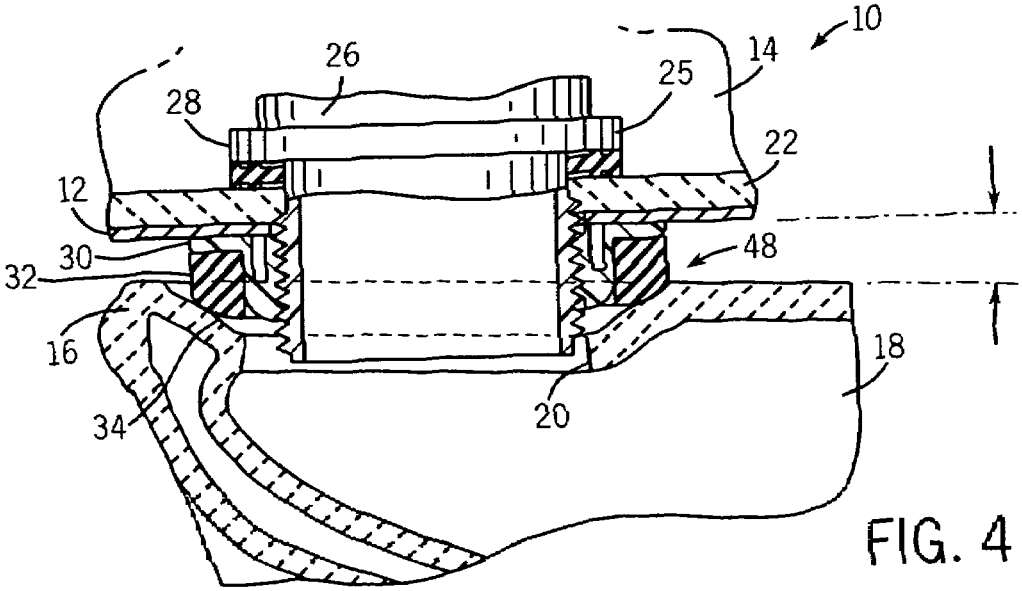
FIG. 4 is a vertical cross sectional view taken through a portion of the tank/base junction area.
Figure 2:
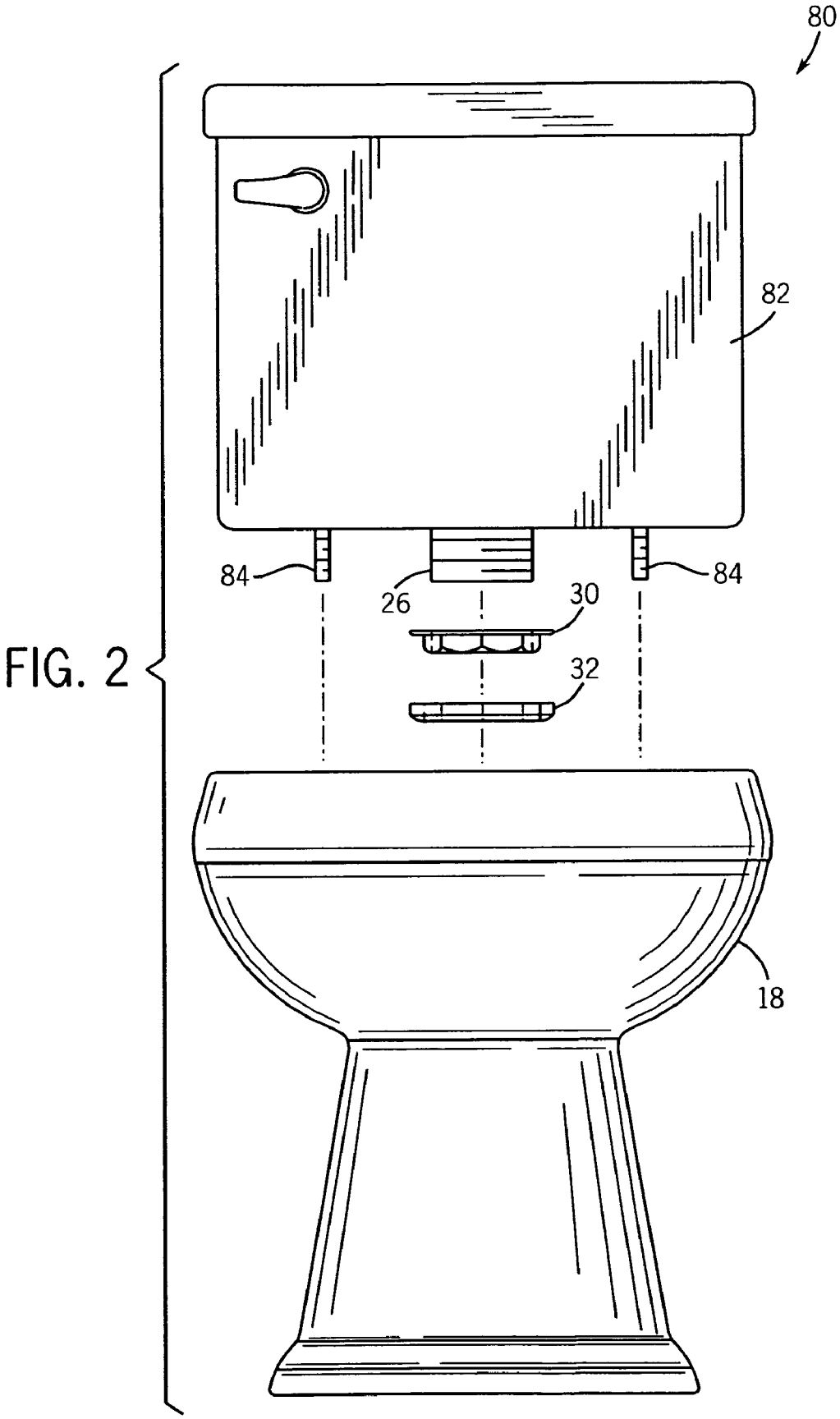
FIG. 2 is a frontal, mostly exploded view thereof.

FIGS. 1 and 4 illustrate a similar principle in the context of front-to-back sloping of the floor 76.

It should be appreciated that given out of plumb conditions in both front-to-back and side-to-side sloping, an adjustment can be made to both. Hence, even though the drawings only depict one such adjustment at a time, multiple adjustments can be simultaneously made.

Figure 3:
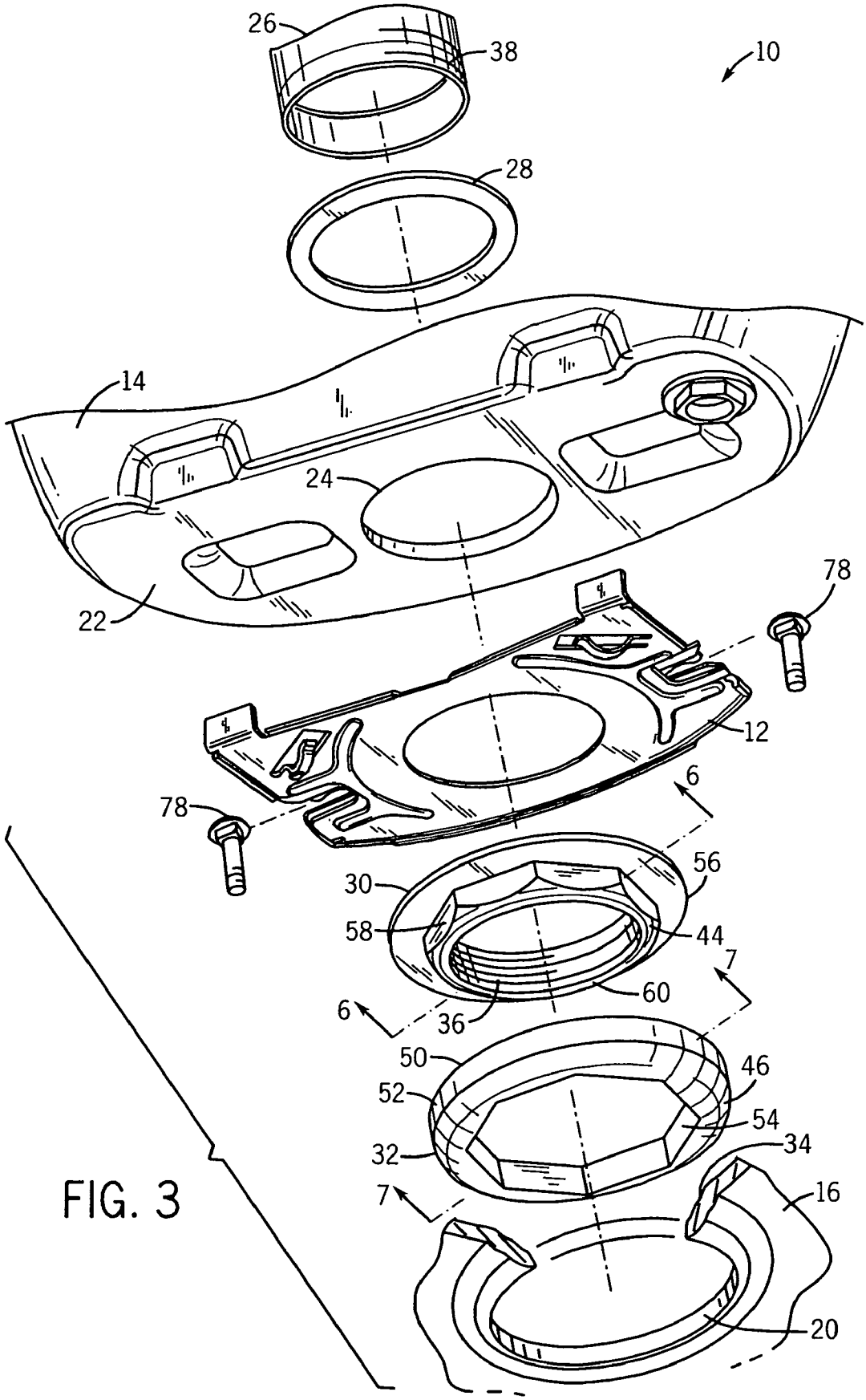
FIG. 3 is an enlarged perspective exploded view, partially fragmented, of a portion of the FIG. 1 embodiment.

With particular reference to FIG. 3, it should be noted that bracket 12 is used with bolts 78 which are not required to pass through the bottom of the toilet tank. Rather, the heads of the bolt 78 are above the bracket with the bolts extending downward through holes in the bowl rear portion (not shown) to permit a clamping with the usual nuts.

In sum, the flush outlet valve extension assembly of the present invention is designed to interact with a prior art dished or sloped receptor surface of the bowl rear portion. The result is to provide an almost ball and socket type joint.

Preferred embodiments of the invention have been described above and depicted in the enclosed drawings. However, many modifications and variations to the preferred embodiments will be apparent to those skilled in the art, which are within the spirit and scope of the present invention. Therefore, the invention is not be limited to just the described embodiments. To ascertain the full scope of the invention, the following claims are referenced.

INDUSTRIAL APPLICABILITY

The present invention provides two-piece type toilets capable of correcting for out of plumb conditions.

I claim:

1. A toilet, comprising:

a tank having an outlet valve, the outlet valve having an extension projecting through a lower wall of the tank;

a bowl having an upper rearward portion with an inlet suitable for receiving water from the tank through the portion;

wherein the extension has mounted thereon:

a nut; and a gasket positioned radially outward of the nut, the gasket having a downwardly and radially inwardly curved convex sealing surface disposed at a lower radially outward edge of the gasket; and wherein the bowl inlet has an inwardly directed entry surface upon which the gasket curved convex sealing surface abuts and seals;

whereby the bowl and gasket form an essentially ball and socket type joint so that the tank can be tilted relative to the bowl rearward portion forward-to-back and/or side-to-side, while maintaining a sealing relationship between the gasket and bowl;

wherein the bowl inlet inwardly directed entry surface is inwardly dished such that the joint comprises abutment of the radially inwardly curved convex sealing surface against said inwardly dished entry surface;

whereby the convex sealing surface is designed to mate with the inwardly dished entry surface .

2. The toilet of claim 1, wherein the nut has a downwardly and radially inwardly curved surface disposed at a radially outward edge of the nut so as to permit a lower edge of the gasket to flex inwardly.

3. The toilet of claim 1, wherein the nut facilitates clamping of the outlet valve to the tank.

4. The toilet of claim 1, wherein the nut extends both above and inward of the gasket.

5. The toilet of claim 1, wherein the gasket has a flat upper annular ring surface, and an outer circumferential vertically extending surface depending from said flat annular ring surface; and wherein the downwardly and radially inwardly curved convex sealing surface of the gasket depends from said vertically extending surface.

6. The toilet of claim 1, wherein the nut has a polygonal array of radially outward sides, and the gasket has a polygonal inner configuration suitable to tightly abut against said array.

7. The toilet of claim 1, wherein the inlet of the bowl has an upper inwardly dished surface linked to a somewhat lower outwardly dished surface.

8. The toilet of claim 1, wherein said gasket is formed from a compressible material.

9. The toilet of claim 1, wherein the gasket is formed from a synthetic plastic foam.

10. The toilet of claim 1, further comprising a bracket positioned between said tank and nut, the bracket supporting a fastener that extends from above the bracket, albeit below the tank, through a portion of the rearward portion of the bowl.

11. A method of adjusting a tank of a toilet to essentially correct for out of plumb floor support conditions, the method comprising:

obtaining a toilet of claim 10 and positioning it on a floor that is out of plumb;

tilting a tank of the toilet relative to its bowl to establish a more plumb configuration for the tank; and thereafter tightening the fastener.

* * * * *